US007516564B2

(12) United States Patent
Ruvang

(10) Patent No.: US 7,516,564 B2
(45) Date of Patent: Apr. 14, 2009

(54) HAMMERLESS C-CLAMP AND WEDGE CONNECTOR SYSTEM

(75) Inventor: John A. Ruvang, Lake Dallas, TX (US)

(73) Assignee: Hensley Industries, Inc., Dallas, TX (US)

( * ) Notice: Subject to any disclaimer, the term of this patent is extended or adjusted under 35 U.S.C. 154(b) by 147 days.

(21) Appl. No.: 11/746,343

(22) Filed: May 9, 2007

(65) Prior Publication Data

US 2008/0276500 A1 Nov. 13, 2008

(51) Int. Cl.
*E02F 9/28* (2006.01)

(52) U.S. Cl. ..... 37/456; 403/374.3

(58) Field of Classification Search ..... 37/446, 37/452–458; 172/719, 772, 772.5; 403/374.3, 403/374.1, 373
See application file for complete search history.

(56) References Cited

U.S. PATENT DOCUMENTS 3,032,152 A 5/1962 Titsler
3,462,861 A 8/1969 Kampert
4,433,496 A 2/1984 Jones et al.
4,932,145 A 6/1990 Reeves, Jr.
5,438,774 A * 8/1995 Fletcher et al. ..... 37/456
5,452,529 A 9/1995 Neuenfeldt et al.
5,564,206 A 10/1996 Ruvang
5,964,547 A 10/1999 Brinkley
2006/0037219 A1 2/2006 Robinson et al.

OTHER PUBLICATIONS

Patent Cooperation Treaty—United States International Searching Authority, Notification of Transmittal of the International Search Report and the Written Opinion of the International Searching Authority, or the Declaration, Aug. 15, 2008, 11 pages, International Application No. PCT/US2008/059896, Alexandria, Virginia USA.

* cited by examiner

*Primary Examiner*—Robert E Pezzuto
(74) *Attorney, Agent, or Firm*—Haynes and Boone, LLP

(57) ABSTRACT

A ground-engaging wear member is releasably retained on an associated support structure by a specially designed hammerless C-clamp and wedge connector system extending through aligned openings in the wear member and support structure. Illustratively, the wear member is an adapter, and the support structure is a bucket lip.

28 Claims, 2 Drawing Sheets

10
24
32a
32
64
64a
64b
20
18
14
68
66
66a
66b
34a
34
REAR
45
2
38
36
44
30
54
52
40
46
48
26
42
22
86
62
28
84
50
12
56
76
80
60
74
82
76A
58
16
FRONT

HAMMERLESS C-CLAMP AND WEDGE CONNECTOR SYSTEM

BACKGROUND OF THE INVENTION

The present invention generally relates to ground-engaging apparatus and, in a representatively illustrated embodiment thereof, more particularly provides a specially designed connector system useable to releasably retain a ground-engaging wear member, such as an adapter, on an associated support structure, such as a bucket lip.

A variety of types of ground-engaging structures are typically provided with replaceable wear portions that are removably carried by larger base or support structures and come into abrasive, wearing contact with the material being displaced by the round-engaging structures. For example, the support structure might be an excavating bucket lip, and the wear portion might be an adapter which is removably secured to the bucket lip. To captively retain the adapter on the bucket lip, generally aligned transverse openings are formed through these elements, and a suitable connector structure is driven into and forcibly retained within the aligned openings to releasably anchor the replaceable adapter on the bucket lip.

The connector structure typically has to be forcibly driven into the aligned adapter and bucket lip openings (or the aligned openings in other types of telescoped wear and support members such as a tooth point disposed on an adapter) using, for example a sledge hammer. Subsequently, the inserted connector structure has to be forcibly pounded out of the aligned adapter and bucket lip openings to permit the worn adapter to be removed from the bucket lip and replaced. This conventional need to pound in and later pound out the connector structure can easily give rise to a safety hazard for the installing and removing personnel.

Various alternatives to pound-in connector structures have been previously proposed for use in releasably retaining a replaceable wear member, such as an adapter, on a support structure, such as an excavating bucket lip. While these alternative "hammerless" connector structures desirably eliminate the need to pound a connector structure into and out of telescoped wear and support members they typically present various other types of problems, limitations and disadvantages including, but not limited to, complexity of construction and use and inconvenient access for installation and removal. A need accordingly exists for improved wear member/support member connector structure and associated methods. It is to this need that the present invention is directed.

SUMMARY OF THE INVENTION

In carrying out principles of the present invention, in accordance with a representatively illustrated embodiment thereof, ground engaging apparatus is provided which comprises a support structure, illustratively a bucket lip, and a wear member releasably positioned on the support member and extending in a front-to-rear direction along a first axis. Extending through the coupled support structure and wear member, along a second axis perpendicular to the first axis, is a connector receiving passage formed by aligned openings in the support structure and wear member.

The wear member is captively and releasably retained on the support structure by a specially designed hammerless connector system that extends through the connector receiving passage and blocks removal of the wear member from the support structure. The connector system illustratively has three primary components—a spool structure, a wedge structure, and adjustment force generating structure.

The spool structure extends through a rear portion of the connector receiving passage, the spool structure having a rear surface portion bearing against the wear member, and a front surface portion. The wedge structure longitudinally extends through a central portion of the connector receiving passage and has nonparallel front and rear side surface portions, and a rear side surface portion extending parallel to and slidably engaging the front surface portion of said spool structure.

The adjustment force generating structure is disposed in a front portion of the connector receiving passage and has a rear side portion slidingly engaging the front side surface portion of the wedge structure. The adjustment force generating structure is operative to longitudinally drive the wedge structure in opposite directions generally parallel to the second axis to selectively expand and permit contraction of the hammerless connector system parallel to the first axis. In this manner, the connector system may be periodically expanded in the front -to-rear direction to "tighten" the wear member on the support structure to compensate for operational surface wear therebetween. The placement of the adjustment force generating structure forwardly of the wedge structure conveniently permits this tightening adjustment without the necessity of reaching rearwardly over the wedge or climbing into the bucket.

According to an aspect of the invention, facing portions of the spool and wedge structures have a sliding tongue and groove interconnection that inhibits relative rotation therebetween about an axis longitudinally extending through the connector receiving passage, along the length of the wedge structure, and sloped relative to the second axis. Additionally, facing portions of the wedge and adjustment force generating structures may have a sliding tongue and groove interconnection that inhibits relative rotation therebetween about an axis parallel to the second axis.

The wear member has first and second cross portions having oppositely facing rearwardly and outwardly sloping side surfaces disposed rearwardly adjacent said connector receiving passage and spaced apart in a direction parallel to the second axis, and forwardly facing end surface portions. According to a further aspect of the invention, the spool structure has a rear side surface portion positioned and configured to abut the forwardly facing end surface portions in response to initial operative installation of the connector system in the connector receiving passage, whereby the forwardly facing end surface portions block further rearward movement of the spool structure, and a pair of rearwardly projecting opposite end portions with inner side surfaces positioned and configured to complementarily engage the oppositely facing rearwardly and outwardly sloping side surfaces of the wear member cross portions.

In a representatively illustrated embodiment thereof, the adjustment force generating structure comprises a body portion, a cylindrical, externally threaded screw member, and a drive stem. The body portion is disposed forwardly of said wedge structure within the connector receiving passage, is supported by the support structure, and has an opening extending therethrough in a direction parallel to the second axis.

The screw member is rotatably received in the body portion and has an opening extending axially therethrough in alignment with opposite end portions of the body portion opening, the screw member being in threaded, driving engagement with the wedge structure.

The drive stem extends through the body portion and screw member openings, the drive stem being rotationally locked to the screw member but rotatable within the body portion opening, the drive stem captively retaining the screw member within the body portion and being captively retained on the screw member.

DETAILED DESCRIPTION

Figure 1:
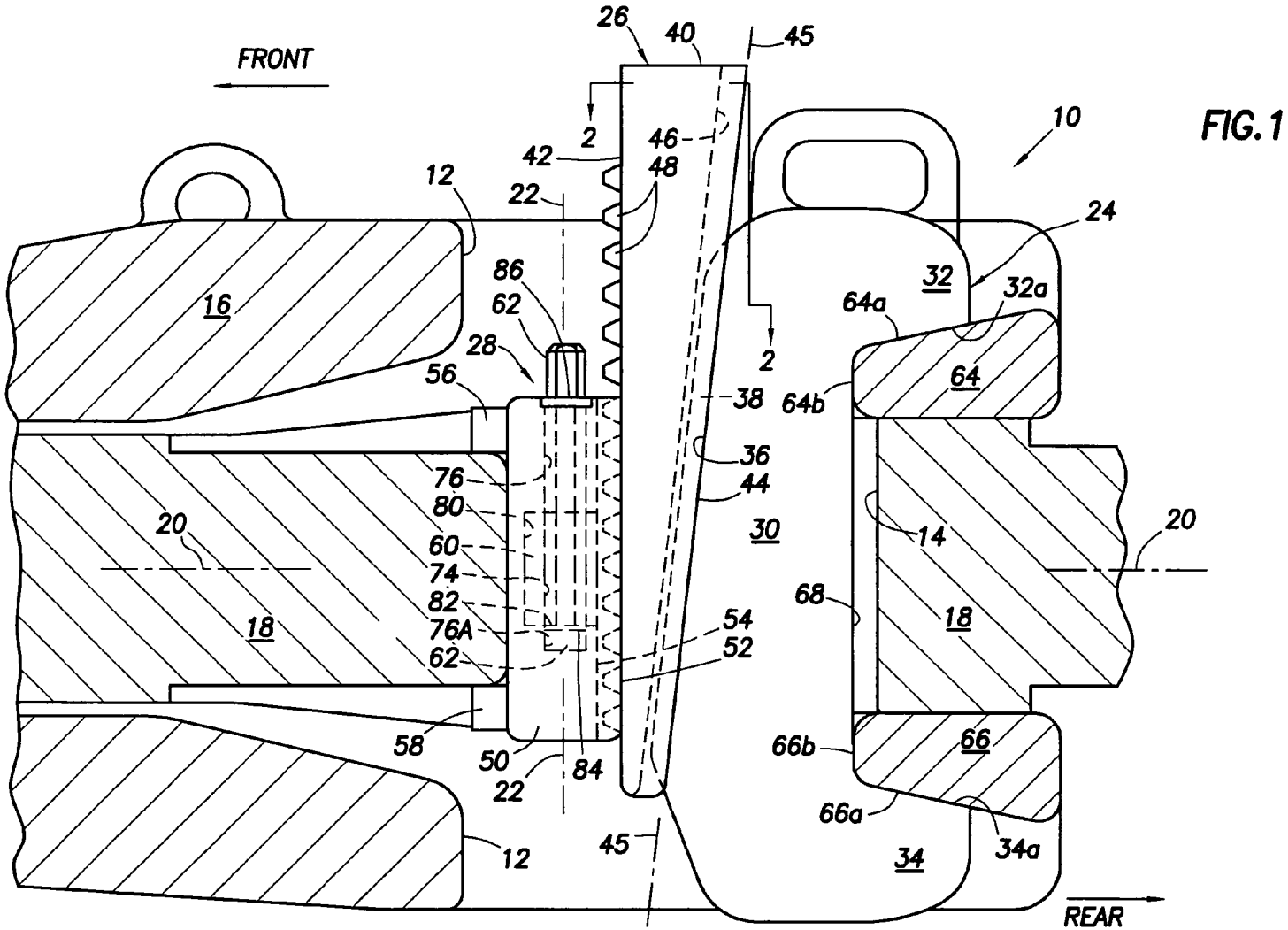
FIG. 1 is a partially elevational longitudinally foreshortened cross-sectional view through a ground-engaging wear member telescoped onto a support structure and captively retained thereon by a specially designed hammerless C-clamp and wedge connector system embodying principles of the present invention.
Figure 2:
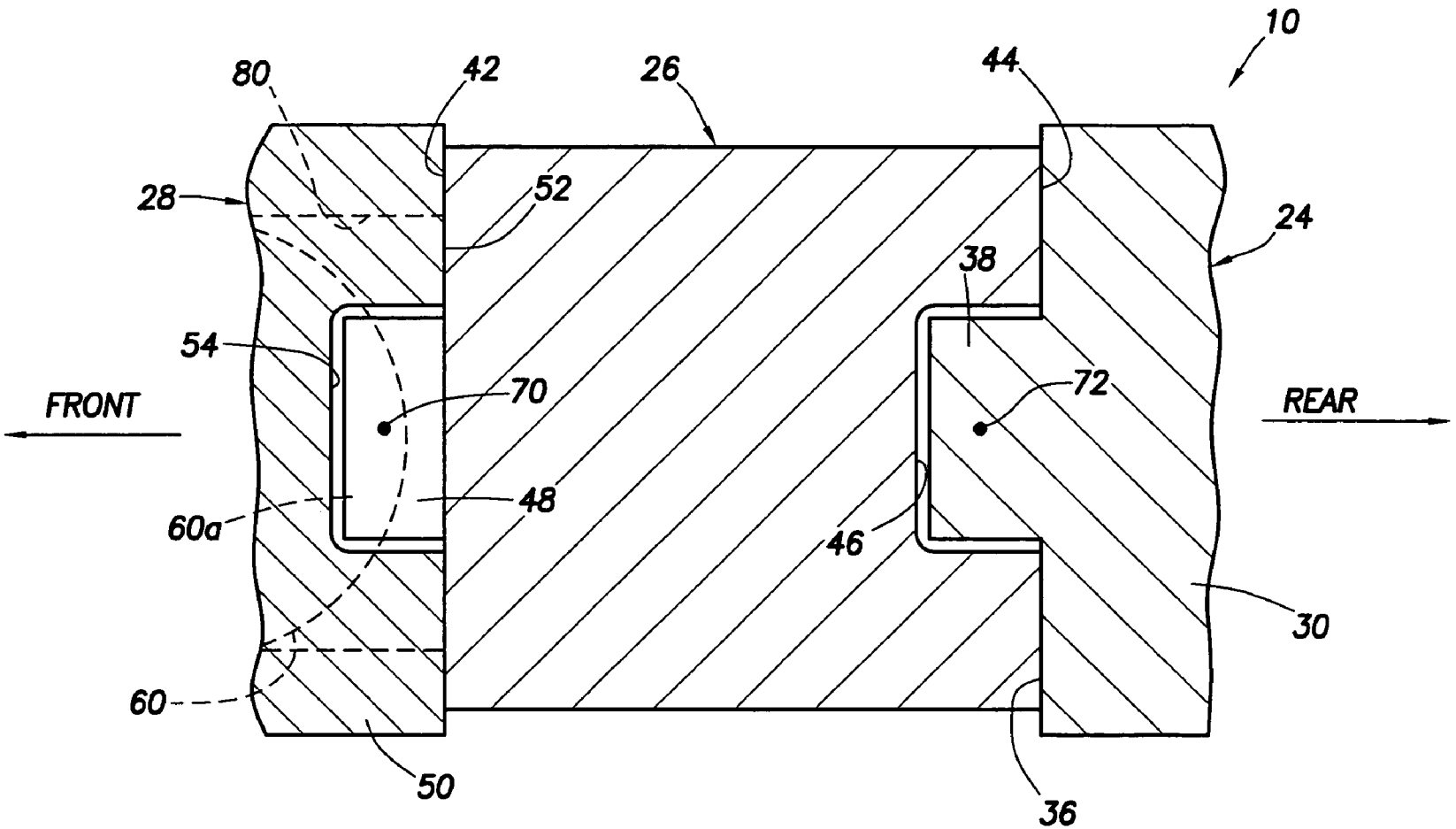
FIG. 2 is an enlarged cross-sectional view through the connector system taken generally along line 2-2 of FIG. 1.

Illustrated in FIGS. 1 and 2 is a specially designed hammerless C-clamp and wedge connector system 10 which is removably insertable into aligned openings 12,14 respectively formed in an adapter 16 that straddles a front edge portion of a bucket lip 18. Adapter 16 may be generally referred to as a wear member, and may alternatively be another type of wear member, such as for example, a replaceable tooth point. The bucket lip 18 may be generally referred to as a support structure, and may alternatively be another type of a support structure, such as for example an adapter, onto which a wear member may be telescoped.

The connected adapter 16 and lip 18 extend, in a front-to-rear direction, along a horizontal axis 20 which is the longitudinal axis of the adapter 16 and is perpendicular to a vertical reference axis 22 passing through the openings 12,14. The aligned connector openings 12,14 collectively define a connector receiving passage extending through the wear and support structures 16,18. Illustratively, connector system 10 includes a spool or C-clamp member 24, a wedge member 26, and a screw shim assembly 28.

Spool 24, as viewed in FIG. 1, has a generally C-shaped configuration (and, in the earth engaging industry, is often called a C-clamp), having a vertically elongated body 30 with rearwardly extending projections 32,34 on its top and bottom ends. Along the front side of the spool body 30 is a generally planar surface 36 having a vertically elongated central rib 38 laterally projecting forwardly therefrom.

Wedge 26, as viewed in FIG. 1, has a horizontal top end surface 40, a vertically elongated, generally planar front side surface 42 extending transversely to the top end surface 40 and parallel to the vertical reference axis 22, and a vertically elongated, generally planar rear side surface 44 having a vertically elongated central rectangular notch 46 formed therein. Rear side surface 44 lies in a plane 45 which is forwardly and downwardly sloped, thereby being inclined relative to both of the axes 20 and 22. Extending vertically along a laterally central portion of the front side surface 42 of the wedge 26 are a vertically spaced series of forwardly projecting teeth 48. Teeth 48 form a longitudinally spaced series of drivable portions on the wedge 26 and may alternatively be defined by portions of the wedge positioned between vertically spaced recesses in the front wedge side surface 42.

Screw shim assembly 28, as viewed in FIG. 1, has a vertically elongated body 50 with a vertically elongated, generally planar rear side surface 52 having a vertically elongated central notch 54 formed therein. Forwardly extending projections 56,58 are respectively formed on the top and bottom ends of the body 50. Recessed within the interior of the body 50 is a screw structure 60 which is rotationally drivable, about the vertical reference 22, using a vertically oriented drive stem 62 extending downwardly through the top end of the shim body 50 and rotationally locked to the internal screw structure 60. As illustrated, the threads 60*a* of the screw structure 60 (see FIG. 2) extend outwardly through the rearwardly facing inner surface of the shim body notch 54, and rearwardly into the notch 54, but to not extend rearwardly to the rear body side surface 52, as best illustrated in FIG. 2.

With the connector system 10 initially installed in the adapter and lip openings 12 and 14 as shown in FIG. 1, the rearwardly extending spool projections 32,34 respectively extend along sloping outer sides of top and bottom tapered rear cross-piece portions 64,66 of the adapter 16, the front side spool rib 38 is received in the rear side notch 46 of the wedge 26, and the vertically canted front side surface 36 of the spool 24 is in slidable engagement with the similarly canted rear side surface 44 of the wedge 26 in the inclined plane 45. The shim body projections 56,58 extend forwardly along top and bottom side portions of the lip 18 adjacent the front side of the lip opening 14, the wedge teeth 48 are received in the rear shim body notch 54 in drivable engagement with the threads of the screw structure 60, and the facing side surfaces 42,52 of the wedge 26 and the shim body 50 are in slidable engagement with one another in a plane parallel to the vertical, non-canted reference axis 22.

When the stem 62 is rotated in the appropriate direction, the interaction between the rotating screw structure 60 and the wedge teeth 48 which its threads drivingly engage move the wedge 26 downwardly in a direction parallel to the reference axis 22. Via the resulting sliding interaction between the inclined wedge and spool side surfaces 36,44, such downwardly driven movement of the wedge 26 relative to the stationary spool 24 horizontally expands the assembly 10 in a rearward direction, forcing the spool 24 rearwardly to tighten the adapter 16 on the lip 18 and releasably retain the connector system 10 in place within the openings 12,14 to thereby detachably hold the adapter 16 on the lip 18. The tightening action of the assembly 10 may be employed both in the initial installation of the wear member 16 on the support structure 18, and after their interface areas wear away after use of the wear member/support structure apparatus 16,18. By rotating the stem 62 in the opposite direction, the wedge 26 is moved upwardly relative to the spool 24, thereby permitting the assembly 10 to be laterally contracted so that it can be removed from the openings 12,14 to permit removal of the adapter 16 from the lip 18.

As described above, the screw structure 60 is rotatable about an axis 22 which is perpendicular to the horizontal axis 20, and the slidingly engaged shim and wedge surfaces 42,52 are parallel to the axis 22 and thus lie in a plane perpendicular to the axis 20. The threads of the screw structure 60 do not extend outwardly through any surface against which the wedge 26 slidingly bears.

It can be seen from the foregoing that the connector system 10 may be operatively installed within and subsequently removed from the aligned wear member/support structure openings 12,14 without having to pound on any portion of the system, thereby making the system 10 a truly "hammerless" one. It should additionally be noted that the present invention's placement of the adjustment portion of the system 10 (namely, the screw shim assembly 28) in front of the spool 24 advantageously permits a worker installing or removing the system 10 to reach such adjustment portion from the front side of the wedge 26 as opposed to having to reach rearwardly over the wedge 26 or climb into the bucket to loosen or tighten the system 10 within the aligned openings 12,14. This forward placement of the screw shim assembly 28 is facilitated by the illustrated positioning of the teeth 48 on the front side of the wedge 26.

In accordance with a further feature of the connector system 10, the spool 24 is provided with a special configuration that enhances the dimensional stability of the installed system 10 and additionally increases the operational strength of the spool 24. Specifically, with the system 10 in its initially installed orientation shown in FIG. 1, (1) the sloping inner side surfaces 32*a*,34*a* of the rearwardly extending spool body end projections 32,34 respectively and complementarily engage the sloping outer side surfaces 64*a*,66*a* of the adapter cross pieces 64 and 66 to thereby retain the spool 24 in the aligned openings 12,14 and keep the spool 24 from vertically shifting relative to the adapter 16, and (2) the front end surfaces 64*b*,66*b* of the adapter cross pieces 64,66 abut the vertical rear side surface 68 of the spool body 30 in a manner preventing a rearwardly directed operational force imposed on the spool 24 from permitting the sloping cross piece surfaces 64*a*,66*a* from exerting appreciable vertical forces on the spool end portions 32,34 which could break one of them off and permit the system 10 from being unintentionally dislodged from the aligned adapter/support structure openings 12,14.

An additional feature of the connector system 10 resides in the tongue and groove connection between the screw shim assembly body 50 and the wedge 40 (illustratively defined by the receipt of the wedge teeth 48 within the body notch 54), and the tongue and groove connection between the wedge 40 and the spool 24 (illustratively defined by the receipt of the central spool rib 38 in the rear side wedge notch 46). As can best be seen in FIG. 2, these tongue and groove connections substantially inhibit relative side-to-side rotation of the shim body 50 and wedge 26 about the axis 70, as well as substantially inhibiting relative side-to-side rotation of the wedge 26 relative to the spool 24 about the axis 72. In this manner, the overall assembly 10 is stabilized against undesirable side-to-side "wobble" of its interconnected components.

A still further feature of the connector system 10 is the unique construction of its screw shim assembly 28 which, as previously described herein, comprises the body 50, the screw structure 60, and the drive stem 62. The screw shim assembly 28, which may also be referred to as an adjustment force generating apparatus, is assembled in a manner such that these three separate components thereof are releasably locked to one another so that the screw member 60 and its associated drive stem 62 are not unintentionally separated from one another during installation or removal of the connector system 10 from the aligned wear member/support structure connector openings 12,14.

The screw structure 60 has a vertically elongated, cylindrical, externally threaded configuration with a hexagonally cross-sectioned central passage 74 extending axially therethrough. Body 50 has a circularly cross-sectioned central passage 76 vertically extending inwardly through the top end thereof and having a lower end portion 76a. The lower passage end portion 76*a* is vertically separated from the balance of the passage 76 by a cutout area 80 extending forwardly through the rear side surface 52 of the shim body 50 and adapted to rotatably receive the screw structure 60. Drive stem 62 has a hexagonal cross-section along its length and is rotatably receivable in the circularly cross-sectioned body passage 76, and complementarily (and thus rotationally lockably) receivable in the hexagonally cross-sectioned screw structure passage 74.

To construct the screw shim assembly 28, the screw structure 60 is first inserted forwardly into the screw shim body cutout area 50 to its FIG. 1 orientation therein. The drive stem 62 is then inserted downwardly through the circular body passage 76, the hexagonal screw structure passage 74 and into the lower end portion 76*a* of the body passage 76 to thereby place the drive stem notch 82 just below the lower end of the inserted screw structure 60 within the cutout area 80. A generally C-shaped resilient retaining clip member 84 (commonly referred to in the fastening industry as a "cir-clip") is then pushed forwardly into the cutout area 80 in a manner causing it to snap into the annular drive stem notch 82 just beneath the lower end of the screw structure 60 to thereby prevent upward withdrawal of the drive stem 62 from the balance of the screw shim assembly 28. As can be seen, the captively retained drive stem 62 prevents rearward dislodgement of the screw structure 60 from the body cutout area 80.

As previously described, rotation of the drive stem 62 relative to the shim body 50 rotationally drives the screw structure 60 to forcibly drive the wedge 40 in a selected vertical direction. Illustratively, a resilient 0-ring seal 86 is installed at the upper end of the shim body 50, around the drive stem 62, to inhibit the entry of dirt into the interior of the shim body 50 and also to grip the stem 62 and help maintain it in the particular rotationally adjusted orientation thereof relative to the shim body 50.

A variety of modifications can be made to the representatively illustrated connector system 10 without departing from principles of the present invention. For example, by appropriately reconfiguring the spool 24 and body 50, the wedge 26 could be reversed so that its front side surface 42 was vertically sloped, and its rear side surface 44 longitudinally extended parallel to the axis 22, or both the front and rear sides 42,44 of the wedge 26 could be sloped relative to the axis 22. Additionally, the overall adjustment force generating structure 28 could have a variety of alternate configurations if desired.

The foregoing detailed description is to be clearly understood as being given by way of illustration and example only, the spirit and scope of the present invention being limited solely by the appended claims.

What is claimed is:

1. Ground engaging apparatus comprising:

a support structure;

a wear member releasably positioned on said support structure and extending in a front-to-rear direction along a first axis;

a connector receiving passage extending through said support structure and said wear member along a second axis transverse to said first axis; and a hammerless connector system extending through said connector receiving passage and releasably retaining said wear member on said support structure, said connector system comprising:

a spool structure extending through a rear portion of said connector receiving passage, said spool structure having a rear surface portion bearing against said wear member, and a front surface portion, a wedge structure longitudinally extending through a central portion of said connector receiving passage and having nonparallel front and rear side surface portions, said rear side surface portion of said wedge structure extending parallel to and slidably engaging said front surface portion of said spool structure, and an adjustment force generating structure disposed in a front portion of said connector receiving passage and having a rear side portion slidingly engaging said front side surface portion of said wedge structure, said adjustment force generating structure being operative to longitudinally drive said wedge structure in selectively opposite directions to selectively expand and permit contraction of said hammerless connector system parallel to said first axis.

2. The ground engaging apparatus of claim 1 wherein:

said wear member is an adapter, and said support structure is a bucket lip.

3. The ground engaging apparatus of claim 1 wherein:

facing portions of said spool structure and said wedge structure have a sliding tongue and groove interconnection that inhibits relative rotation therebetween about an axis longitudinally extending through said connector receiving passage and sloped relative to said second axis.

4. The ground engaging apparatus of claim 1 wherein:

facing portions of said wedge structure and said adjustment force generating structure have a sliding tongue and groove interconnection that inhibits relative rotation therebetween about an axis longitudinally extending through said connector receiving passage.

5. The ground engaging apparatus of claim 4 wherein:

facing portions of said spool structure and said wedge structure have a sliding tongue and groove interconnection that inhibits relative rotation therebetween about an axis longitudinally extending through said connector receiving passage.

6. The ground engaging apparatus of claim 1 wherein:

said wear member has first and second cross portions having oppositely facing rearwardly and outwardly sloping side surfaces disposed rearwardly adjacent said connector receiving passage and spaced apart in a direction parallel to said second axis, and forwardly facing end surface portions, and said spool structure has a rear side surface portion positioned and configured to abut said forwardly facing end surface portions in response to initial operative installation of said hammerless connector system in said connector receiving passage, whereby said forwardly facing end surface portions block further rearward movement of said spool structure, and a pair of rearwardly projecting opposite end portions with inner side surfaces positioned and configured to complementarily engage said oppositely facing rearwardly and outwardly sloping side surfaces of said wear member.

7. The ground engaging apparatus of claim 1 wherein:

said adjustment force generating structure includes a screw structure threadingly engaging a front side portion of said wedge structure and being rotatable to drive said wedge structure in selectively opposite longitudinal directions generally parallel to said second axis.

8. The ground engaging apparatus of claim 7 wherein:

said wedge structure has a longitudinally spaced series of forwardly projecting teeth disposed thereon and operatively engaged by said screw structure.

9. The ground engaging apparatus of claim 8 wherein:

said adjustment force generating structure further includes a body portion within which said screw structure is rotatably disposed, said body portion having a rear side notch into which said teeth forwardly extend.

10. The ground engaging apparatus of claim 1 wherein said adjustment force generating structure comprises:

a body portion disposed forwardly of said wedge structure within said connector receiving passage, a screw structure captively retained within said body portion and being threadingly and drivingly engaged with said wedge structure, and a drive stem extending through said body portion, captively retained thereon, and being drivingly coupled to said screw structure.

11. The ground engaging apparatus of claim 10 wherein:

said body portion has a spaced apart pair of forwardly extending projections disposed on opposite side portions of said support structure and limiting movement of said body portion in a direction generally parallel to said second axis.

12. The ground engaging apparatus of claim 1 wherein said adjustment force generating structure comprises:

a body portion disposed forwardly of said wedge structure within said connector receiving passage, said body portion being supported by said support structure and having an opening extending therethrough, a cylindrical, externally threaded screw member rotatably received in said body portion and having an opening extending axially therethrough in alignment with opposite end portions of said body portion opening, said screw member being in threaded, driving engagement with said wedge structure, and a drive stem extending through said body portion and screw member openings, said drive stem being rotationally locked to said screw member but rotatable within said body portion opening, said drive stem captively retaining said screw member within said body portion and being captively retained on said screw member.

13. The ground engaging apparatus of claim 12 wherein:

said drive stem has an annular notch externally formed thereon, and said drive stem is captively retained on said screw member by means of a resilient clip member removably received in said annular notch.

14. The ground engaging apparatus of claim 12 wherein:

said drive stem extends outwardly from said body portion through an exterior surface portion thereof, and said adjustment force generating structure further comprises a resilient annular seal member circumscribing said drive stem adjacent said exterior surface portion of said body portion.

15. A hammerless connector system for use in removably retaining a ground engaging wear member on a support structure, the coupled ground engaging member and support structure extending in a front-to-rear direction along a first axis and having aligned connector openings forming a connector receiving extending through the coupled ground engaging member and support structure along a second axis perpendicular axis, the hammerless connector system being operatively positionable in the connector receiving passage and comprising:

a spool structure positionable in a rear portion of the connector receiving passage in a manner such that a rear surface portion of said spool structure rearwardly bears against the wear member;

a wedge structure positionable to extend through a central portion of the connector receiving passage, a rear side surface of said wedge structure extending parallel to and slidably engaging a front surface portion of said spool structure; and an adjustment force generating structure positionable in a front portion of the connector receiving passage in a manner such that a rear side portion of said adjustment force generating structure slidingly engages said front side surface portion of said wedge structure, said adjustment force generating structure being operative to longitudinally drive said wedge structure in selectively opposite directions generally parallel to the second axis to selectively expand and permit contraction of the installed hammerless connector system parallel the first axis.

16. The hammerless connector system of claim 15 wherein:

portions of said spool and wedge structures are interengageable in a tongue and groove connection operative to inhibit relative rotation thereof about an axis longitudinally extending along the length of said wedge structure.

17. The hammerless connector system of claim 15 wherein:

portions of said wedge and adjustment force generating structures are interengageable in a tongue and groove connection operative to inhibit relative rotation thereof about an axis longitudinally extending along the length of said wedge structure.

18. The hammerless connector system of claim 17 wherein:

portions of said spool and wedge structures are interengageable in a tongue and groove connection operative to inhibit relative rotation thereof about an axis longitudinally extending along the length of said wedge structure.

19. The hammerless connector system of claim 15 wherein:

the wear member has first and second cross portions having oppositely facing rearwardly and outwardly sloping side surfaces disposed rearwardly adjacent the connector receiving passage and spaced apart in a direction parallel to the second axis, and forwardly facing end surface portions, and said spool structure has a rear side surface portion positioned and configured to abut said forwardly facing end surface portions in response to initial operative installation of said hammerless connector system in the connector receiving passage, whereby the forwardly facing end surface portions block further rearward movement of said installed spool structure, said spool structure further having a pair of rearwardly projecting opposite end portions with inner side surfaces positioned and configured to complementarily engage the oppositely facing rearwardly and outwardly sloping side surfaces of said first and second cross portions.

20. The hammerless connector system of claim 15 wherein:

said adjustment force generating structure includes a screw structure threadingly engageable with a front side portion of said wedge structure and being rotatable to drive said wedge structure in selectively opposite longitudinal directions.

21. The hammerless connector system of claim 20 wherein:

said wedge structure has a longitudinally spaced series of forwardly projecting teeth disposed thereon and being operatively engageable by said screw structure.

22. The hammerless connector system of claim 21 wherein:

said adjustment force generating structure further includes a body portion within which said screw structure is rotatably disposed, said body portion having a rear side notch configured to receive said wedge structure teeth.

23. The hammerless connector system of claim 15 wherein said adjustment force generating structure comprises:

a body portion operatively positionable forwardly of said wedge structure within the connector receiving passage, a screw structure captively retained within said body portion and being threadingly and drivingly engageable with said wedge structure, and a drive stem extending through said body portion, captively retained thereon, and being drivingly coupled to said screw structure.

24. The hammerless connector system of claim 23 wherein:

said body portion has a spaced apart pair of forwardly extending projections positionable on opposite side portions of the support structure to limit movement of said body portion in a direction generally parallel to the second axis.

25. The hammerless connector system of claim 15 wherein said adjustment force generating structure comprises:

a body portion positionable forwardly of said wedge structure within the connector receiving passage, said body portion being supported by said support structure and having an opening extending therethrough in a direction parallel to said second axis, a cylindrical, externally threaded screw member rotatably received in said body portion and having an opening extending axially therethrough in alignment with opposite end portions of said body portion opening, said screw member being in threaded, driving engagement with said wedge structure, and a drive stem extending through said body portion and screw member openings, said drive stem being rotationally locked to said screw member but rotatable within said body portion opening, said drive stem captively retaining said screw member within said body portion and being captively retained on said screw member.

26. The hammerless connector system of claim 25 wherein:

said drive stem has an annular notch externally formed thereon, and said drive stem is captively retained on said screw member by means of a resilient clip member removably received in said annular notch.

27. The hammerless connector system of claim 25 wherein:

said drive stem extends outwardly from said body portion through an exterior surface portion thereof, and said adjustment force generating structure further comprises a resilient annular seal member circumscribing said drive stem adjacent said exterior surface portion of said body portion.

28. A hammerless connector system for use in removably retaining a ground engaging wear member on a support structure, comprising:

a wedge structure having a length and nonparallel opposite front and rear sides;

a spool structure positionable on said rear side of said wedge structure in sliding engagement therewith, said wedge structure and said spool structure having portions cooperable to form a tongue and groove connection therebetween that stabilizes them against relative rotation about a first axis extending through said wedge structure generally parallel to said length of said wedge structure; and an adjustment force generating structure positionable on said front side of said wedge structure in sliding engagement therewith, said adjustment force generating structure being operative to drive said wedge structure in selectively opposite longitudinal directions relative to said adjustment force generating structure, said wedge structure and said adjustment force generating structure having portions cooperable to form a tongue and groove connection therebetween that stabilizes them against relative rotation about a second axis extending through said wedge structure generally parallel to said length of said wedge structure.

* * * * *